US007305833B2

(12) United States Patent
Pieronczyk et al.

(10) Patent No.: US 7,305,833 B2
(45) Date of Patent: Dec. 11, 2007

(54) BOTTLE COOLING AND WARMING DEVICE

(75) Inventors: Dietmar Pieronczyk, Pordenone (IT); Frederico Verardo, Brugnera (IT); Joseph Teuber, Geuensee (CH)

(73) Assignee: Electrolux Professional S.p.A., Pordenone (IT)

( * ) Notice: Subject to any disclaimer, the term of this patent is extended or adjusted under 35 U.S.C. 154(b) by 133 days.

(21) Appl. No.: 11/243,312

(22) Filed: Oct. 4, 2005

(65) Prior Publication Data

US 2006/0117760 A1 Jun. 8, 2006

Related U.S. Application Data

(60) Provisional application No. 60/632,763, filed on Dec. 3, 2004.

(51) Int. Cl.
*F25B 21/02* (2006.01)

(52) U.S. Cl. ..... 62/3.3; 62/3.61

(58) Field of Classification Search ..... 62/3.3, 62/3.6, 3.61, 3.7
See application file for complete search history.

(56) References Cited

U.S. PATENT DOCUMENTS

| | | | | |
|---|---|---|---|---|
| 3,500,649 | A * | 3/1970 | Feldman | 62/3.6 |
| 3,733,836 | A * | 5/1973 | Corini | 62/3.61 |
| 4,364,234 | A | 12/1982 | Reed | |
| 4,627,242 | A | 12/1986 | Beitner | |
| 5,029,446 | A | 7/1991 | Suzuki | |

FOREIGN PATENT DOCUMENTS

| | | | |
|---|---|---|---|
| DE | 3412556 | A1 | 10/1985 |
| DE | 88006717 | U1 | 5/1988 |
| DE | 4109677 | A1 | 9/1992 |
| DE | 4233172 | A1 | 4/1993 |
| DE | 10015869 | A1 | 10/2001 |
| DE | 20108035 | U1 | 11/2001 |
| DE | 10023476 | A1 | 12/2001 |
| DE | 10030774 | A1 | 1/2002 |
| DE | 10036238 | A1 | 2/2002 |
| DE | 10039058 | A1 | 2/2002 |
| DE | 20211894 | U1 | 12/2002 |
| DE | 20308399 | U1 | 10/2003 |
| DE | 10261366 | A1 | 7/2004 |
| DE | 20313151 | U1 | 9/2004 |
| EP | 0 108 306 | | 5/1984 |
| GB | 2322184 | A | 8/1998 |
| JP | 7-91799 | | 4/1995 |
| JP | 2003/211941 | | 7/2003 |

* cited by examiner

*Primary Examiner*—Melvin Jones
(74) *Attorney, Agent, or Firm*—Pearne & Gordon LLP

(57) ABSTRACT

A cooling and warming apparatus includes a housing having a top side with a number of open receptacles for receiving perishable items. Thermally-conductive bases are attached to the bottom of the receptacles. Thermoelectric elements are provided in thermal communication with the thermally-conductive bases. A heat sink having heat-dissipating fins is provided in thermal communication with at least one of the thermoelectric elements. A fan draws air into the housing, through the heat-dissipating fins of the heat sink, and out of the housing. A temperature controller controls the operation of one of the plurality of thermoelectric elements.

14 Claims, 3 Drawing Sheets

BOTTLE COOLING AND WARMING DEVICE

CROSS REFERENCE TO RELATED APPLICATION

This application claims priority of U.S. Provisional Patent Application No. 60/632,763 filed Dec. 3, 2004, which is incorporated herein by reference.

BACKGROUND OF THE INVENTION

In the food service industry, when preparing sandwiches, salads and the like, it is desirable to have bottles or containers of dressings, sauces, other condiments and beverages easily accessible. This requires an open system having no drawers, doors, or the like and with no extra handles to get in the way. To meet public health regulations requirements (for example, HACCP) for keeping food fit for consumption or use or to prevent the taste from being affected, the food must be stored at certain temperatures or within certain temperature ranges.

There are known devices and equipment that make it possible to keep dressings, sauces and drinks cool in any shaped container. Most of the known systems, including ice and chemical coolers, only allow storage for a limited time, typically several hours, and must be changed or regenerated regularly. This involves additional handling and increased risks, including the risk that the change is made late or not at all. This risk is particularly high when the necessary change must be made at peak operating times, such as during lunch and dinner rushes.

Further, storage at a predetermined temperature or at variable temperatures is not possible with the above mentioned systems. Other systems are known in which temperature settings are possible, but they generally involve rather extensive and complicated designs, such as conventional compressor-based refrigeration apparatuses.

BRIEF SUMMARY OF THE INVENTION

According to one aspect, the present invention provide a cooling and warming apparatus comprising: a housing having a top side, the top side comprising a plurality of apertures; a plurality of receptacles for receiving perishable items, each of the receptacles comprising a bottom end, a top end and a side wall defining a chamber that opens through one of the plurality of apertures in the top side of the housing, said one of the plurality of apertures being adjacent the top end of the receptacle; a plurality of thermally-conductive bases each being attached at a top side to the bottom end of one of the plurality of receptacles; a plurality of thermoelectric elements each being in thermal communication with a bottom side of one of the plurality of thermally-conductive bases; a heat sink having heat-dissipating fins, the heat sink being in thermal communication with at least one of the plurality of thermoelectric elements; a fan for drawing air into the housing, through the heat-dissipating fins of the heat sink, and out of the housing; and a temperature controller for controlling the operation of one of the plurality of thermoelectric elements.

According to another aspect, the present invention provides a cooling and warming apparatus comprising: a housing having a top side removably attached to the housing; a plurality of cylindrical receptacles for receiving perishable items, each of the receptacles having a bottom end and a side wall defining a chamber that opens through one of a plurality of apertures in the top side of the housing, said one of the plurality of apertures opposing the bottom end of the receptacle and having a shape that is different from a cross-section of the receptacle taken parallel to the top side of the housing; a plurality of thermally-conductive bases each being attached at a top side to the bottom end of one of the plurality of receptacles; a plurality of thermoelectric elements each being in thermal communication with a bottom side of one of the plurality of thermally-conductive bases; thermal insulation surrounding each of the plurality of thermally-conductive bases and each of the thermoelectric elements; a plurality of heat sinks having heat-dissipating fins, each of the plurality of heat sinks being in thermal communication with one of the plurality of thermoelectric elements; a cooling and warming fan for drawing air into the housing, through the heat-dissipating fins of the plurality of heat sinks, and out of the housing; a first temperature controller for controlling the operation of one of the plurality of thermoelectric elements, the first temperature controller comprising a core temperature sensor for sensing a temperature of a perishable item contained in one of the plurality of receptacles and controlling the operation of the corresponding one of the plurality of thermoelectric element to maintain the perishable item at a set temperature; and a second temperature controller for controlling the operation of another one of the plurality of thermoelectric elements. At least one of said plurality of thermoelectric elements is configured to heat a corresponding one of the plurality of thermally-conductive bases and another one of said plurality of thermoelectric elements is configured to cool a corresponding one of the plurality of thermally-conductive bases.

DETAILED DESCRIPTION OF THE INVENTION

Figure 1:
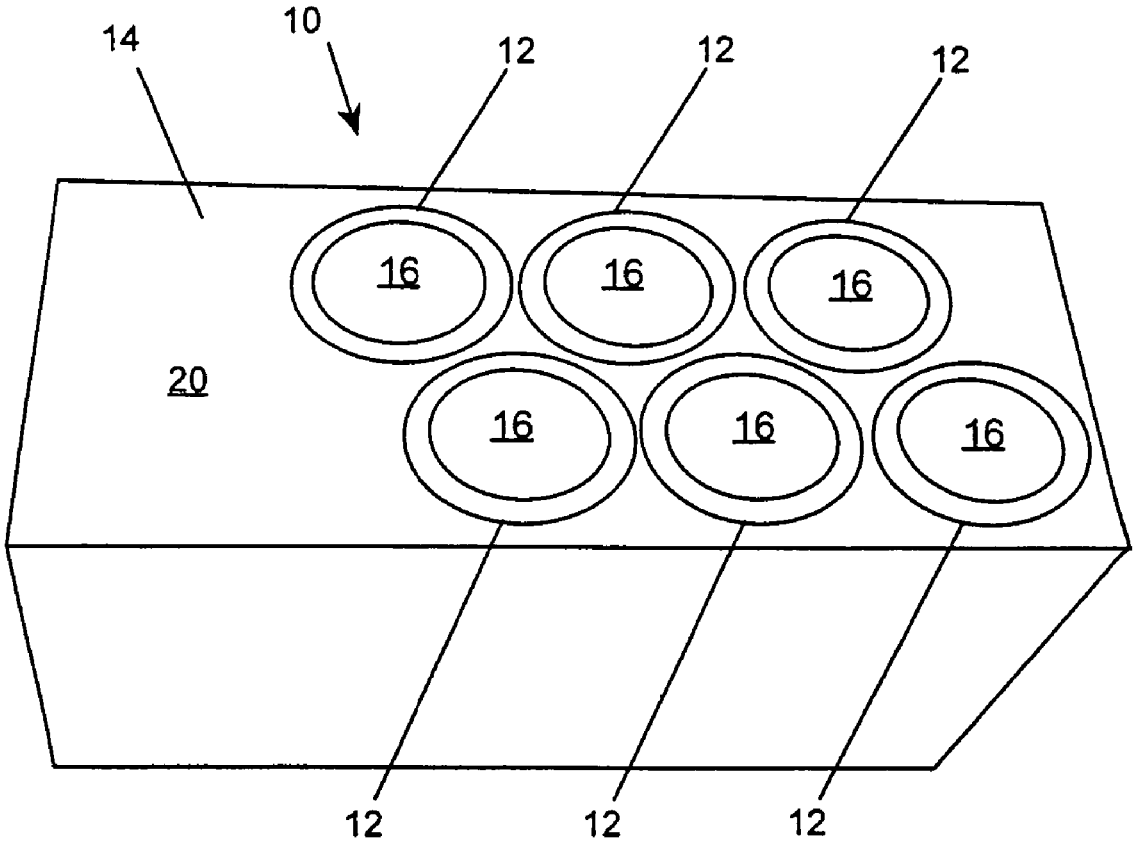
FIG. 1 is a top perspective view of a bottle cooling and warming device according to an embodiment of the present invention.

With reference to FIG. 1, the present invention is a bottle cooling and warming device 10 capable of maintaining one or more readily accessible bottles, cups or other containers at a desired temperature, either cooler or warmer then the ambient temperature, using the known Peltier technique. The device 10 comprises one or more cylinders or receptacles 12 provided within a housing 14. The cylinders 12 define bottle-holding chambers 16 that open through a plurality of apertures or openings 18 provided on a top plate or side 20 of the housing 14.

In the present embodiment of the invention, the bottle cooling and warming device 10 is configured to be used in a food service sandwich preparation station in which the cylinders 12 hold open bottles of condiments. The invention can be adapted for other uses, such as for cooling beverages, or keeping cold and hot buffet items at a proper temperature.

Figure 2:
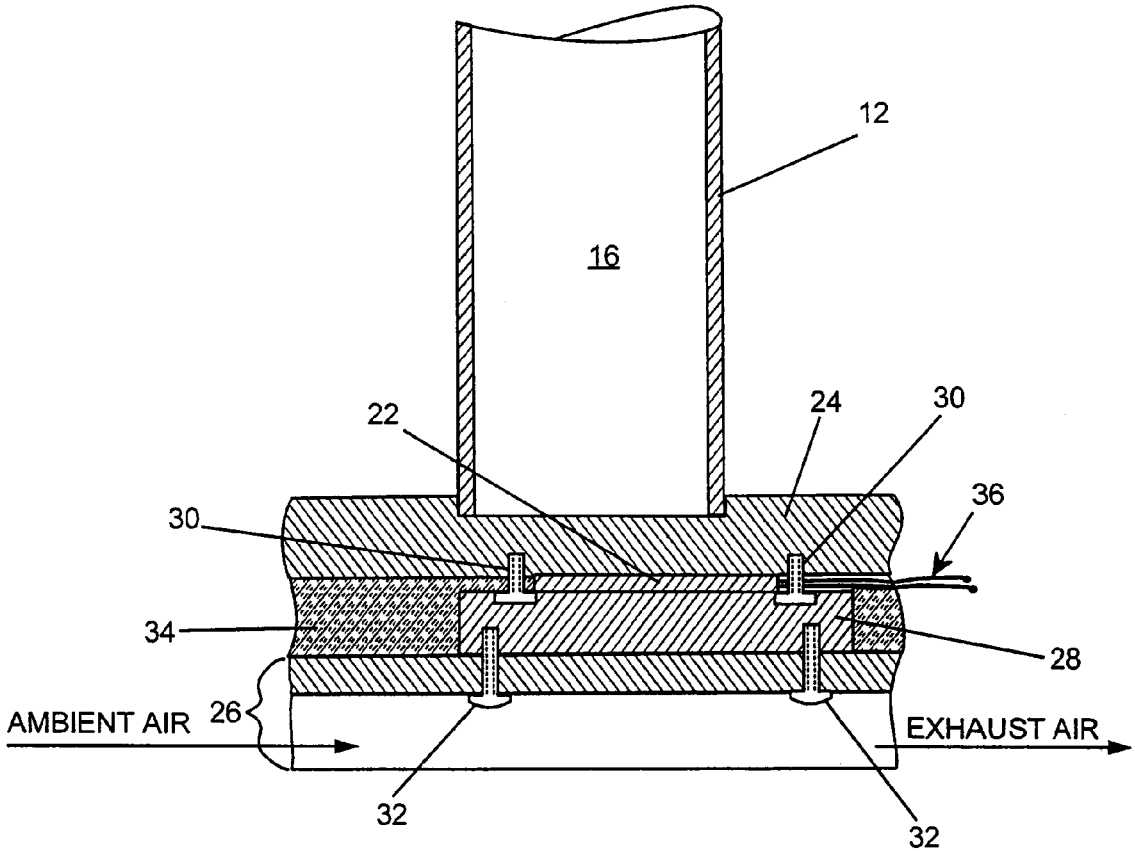
FIG. 2 is a partially schematic sectional view of a portion of the bottle cooling and warming device according to an embodiment of the present invention.

With reference to FIG. 2, the device 10 according to the present embodiment of the invention further comprises so-called Peltier modules 22 that include one or more thermoelectric or Peltier elements, depending on the required bottle capacity and other requirements. Each Peltier modules 22 is clamped between a thermally-conductive base 24 of a cylinder 12. A top side of the thermally-conductive base 24 is attached to the bottom end of the cylinder 12. Alternatively, the thermally-conductive base 24 can be formed integrally with the cylinder 12. A top side of the Peltier module 22 is in thermal communication with a bottom side of the corresponding thermally-conductive base. A heat sink 26 having heat-dissipating or cooling fins provided in thermal communication with a bottom side of the Peltier module 22.

In the present embodiment, all of the thermally active parts are constructed of aluminum or any of various aluminum alloys, which have particularly low thermal resistances. Alternatively, other materials having suitable property including other metals and alloys, such as copper, brass and steel, can be used in place of aluminum. Each Peltier module 22 is attached in such a way as to provide contact over the whole surface at a predetermined compression.

As shown in FIG. 2, the device 10 may include a mounting aid or block 28 for clamping each of the Peltier modules 22 to the thermally-conductive base 24. Screws 30 are provided to secure the mounting aid 28 to the thermally-conductive base 24. Likewise, the heat sink 26 is secured to the mounting aid 28 with additional screws 32. Alternatively, other types of fasteners and mounting structures can be used.

To improve the heat transfer, thermal oil may be applied to all contact surfaces. In the present embodiment, the exposed areas of both the Peltier modules 22 and the thermally-conductive base 24 are covered with thermal insulation 34 to minimize heat losses to the environment.

Figure 3:
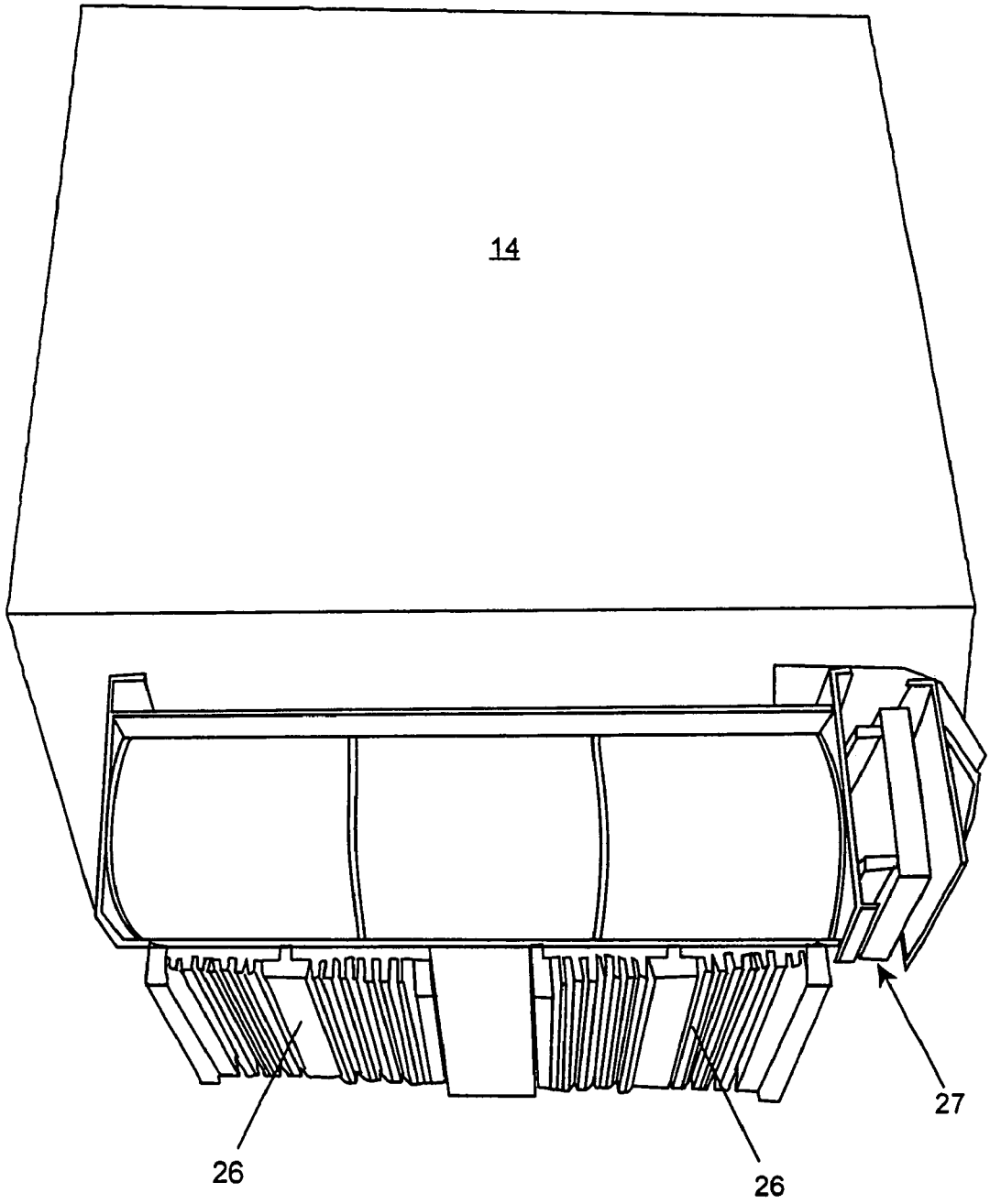
FIG. 3 is a bottom perspective view of the bottle cooling and warming device showing the heat sink and fan thereof.

The cylinders 12 are connected to the thermally-conductive base 24 by any suitable method that results in a joint that permits optimal heat transfer, such as by welding, compression, or the like. Heat is transferred to or from the bottles inserted into the cylinders 12 via the thermally-conductive base 24 and the wall of the cylinders 12, by contact and convection. As best shown in FIG. 3, excess or waste heat that is produced is exhausted to the surrounding area by the heat sink 26 and a cooling fan 27. The cooling fan 27 draws ambient or cool air into the housing 14 and through the cooling fins of the heat sinks 26, which heat the air, and then the heated air is exhausted out of the housing 14. Other types of known heat sinks and/or cooling systems and methods can be used.

It should be appreciated that, according to the present embodiment, when one of the Peltier modules 22 is set at a temperature warmer than the ambient temperature, the corresponding heat sink 26 will be cooled by the Peltier module 22. Thus, the air drawn into the housing 14 by the fan 27 will be cooled, rather than heated.

In order to accommodate different shapes of bottles or other containers, the cylinders 12 can be replaced with tubes or other receptacles having other geometries, depending on the shape of the bottle or other container to be cooled. For example, prism-shaped receptacles could be used in place of the cylinders 12 to hold containers having rectangular and other profiles. Alternatively, an adapter or faceplate (not shown) can be provided adjacent one or more of the openings 18 on the top side 20 of the housing 14 to allow the device 10 to be used for containers of various shapes and sizes without replacing or modifying the cylinders 12. Such adapters can be made of plastic, metal or any other suitable material.

The Peltier modules 22 are connected to a power supply (not shown) via power leads 36. A temperature controller (not shown) controls the power delivered from the power supply to the Peltier modules 22 in order to produce a desired heating or cooling effect. In the present embodiment, the temperature is set and controlled via a capillary tube controller, as is known in the art of temperature control. Alternatively, an electronic temperature controller with one or more temperature sensors, such as the industry standard PT10 or PT1000 platinum resistence thermometers available from Pico Technology Limited, or any other suitable temperature controlling apparatus can be used. According to the present invention, the cylinders 12 can be individually set to desired temperature levels. The device 10 can also be equipped with core sensors that measure the temperature of the food contained in the bottles or other containers and control the Peltier modules 22 to maintain the food at a desired temperature.

Further, in the present embodiment, the temperature controller is designed so that each of the Peltier modules 22 can be individually set to either heat or cool the corresponding cylinder 12. Thus, it is possible heat one or more of the cylinders 12 and, simultaneously, cool one more of the cylinders 12 within the same device 10.

It should be appreciated that, since all of the heat sinks 26 are exposed to the same airflow within the housing 14. Therefore, when some of the Peltier modules 22 are set to heat their cylinders 12 and other Peltier modules 22 are set to cool their cylinders 12, the device 10 will operate more efficiently since some of the waste heat produced by cooling the Peltier modules 22 will be recycled and used to "preheat" the other modules 22.

The present invention provides a compact design allowing the device to fit easily into existing work spaces. Only one connection to a power supply is required to cool all of the cylinders 12. The device 10 is simple to use and maintains the temperature at the set point indefinitely without user intervention.

What is claimed is:

1. A cooling and warming apparatus comprising:

a housing having a top side, the top side comprising a plurality of apertures;

a plurality of receptacles for receiving perishable items, each of the receptacles comprising a bottom end, a top end and a side wall defining a chamber that opens through one of the plurality of apertures in the top side of the housing, said one of the plurality of apertures being adjacent the top end of the receptacle;

a plurality of thermally-conductive bases each being attached at a top side to the bottom end of one of the plurality of receptacles;

a plurality of thermoelectric elements each being in thermal communication with a bottom side of one of the plurality of thermally-conductive bases;

a heat sink having heat-dissipating fins, the heat sink being in thermal communication with at least one of the plurality of thermoelectric elements;

a fan for drawing air into the housing, through the heat-dissipating fins of the heat sink, and out of the housing; and a temperature controller for controlling the operation of one of the plurality of thermoelectric elements for providing a first temperature in one of the plurality of receptacles, and for controlling the operation of a second of the plurality of thermoelectric elements for providing a second temperature in another of the plurality of receptacles.

2. The cooling and warming apparatus of claim 1, wherein the temperature controller comprises a core temperature sensor for sensing a temperature of a perishable item contained in one of the plurality of receptacles and controlling the operation of the corresponding one of the plurality of thermoelectric element to maintain the perishable item at a set temperature.

3. The cooling and warming apparatus of claim 1, wherein the temperature controller comprises a capillary tube.

4. The cooling and warming apparatus of claim 1, wherein one of the receptacles is cylindrical.

5. The cooling and warming apparatus of claim 1, wherein each of the apertures provided in the top side of the housing have a shape that is different from a cross-section of the receptacles taken parallel to the top side.

6. The cooling and warming apparatus of claim 5, wherein the top side is removably attached to the housing.

7. The cooling and warming apparatus of claim 1, wherein at least one of said plurality of thermoelectric elements is configured to heat a corresponding one of the plurality of thermally-conductive bases and another one of said plurality of thermoelectric elements is configured to cool a corresponding one of the plurality of thermally-conductive bases.

8. The cooling and warming apparatus of claim 1, further comprising a second temperature controller for controlling the operation of another one of the plurality of thermoelectric elements.

9. The cooling and warming apparatus of claim 1, wherein the plurality of receptacles, the plurality of thermally-conductive bases, the plurality of thermoelectric elements, and the heat sink each comprise aluminum.

10. The cooling and warming apparatus of claim 1, further comprising thermal insulation surrounding each of the plurality of thermally-conductive bases and each of the thermoelectric elements.

11. A cooling and warming apparatus comprising:

a housing having a top side removably attached to the housing;

a plurality of cylindrical receptacles for receiving perishable items, each of the receptacles having a bottom end and a side wall defining a chamber that opens through one of a plurality of apertures in the top side of the housing, said one of the plurality of apertures opposing the bottom end of the receptacle and having a shape that is different from a cross-section of the receptacle taken parallel to the top side of the housing;

a plurality of thermally-conductive bases each being attached at a top side to the bottom end of one of the plurality of receptacles;

a plurality of thermoelectric elements each being in thermal communication with a bottom side of one of the plurality of thermally-conductive bases;

thermal insulation surrounding each of the plurality of thermally-conductive bases and each of the thermoelectric elements;

a plurality of heat sinks having heat-dissipating fins, each of the plurality of heat sinks being in thermal communication with one of the plurality of thermoelectric elements;

a cooling and warming fan for drawing air into the housing, through the heat-dissipating fins of the plurality of heat sinks, and out of the housing;

a first temperature controller for controlling the operation of one of the plurality of thermoelectric elements, the first temperature controller comprising a core temperature sensor for sensing a temperature of a perishable item contained in one of the plurality of receptacles and controlling the operation of the corresponding one of the plurality of thermoelectric element to maintain the perishable item at a set temperature; and a second temperature controller for controlling the operation of another one of the plurality of thermoelectric elements, wherein at least one of said plurality of thermoelectric elements is configured to heat a corresponding one of the plurality of thermally-conductive bases and another one of said plurality of thermoelectric elements is configured to cool a corresponding one of the plurality of thermally-conductive bases.

12. The cooling and warming apparatus of claim 11, wherein the temperature controller comprises a capillary tube.

13. The cooling and warming apparatus of claim 11, wherein the temperature controller is electronic temperature controller.

14. The cooling and warming apparatus of claim 1, wherein the temperature controller controls the operation of one of the plurality of thermoelectric elements for providing the first temperature independently of the operation of another of the plurality of thermoelectric elements for providing the second temperature.

* * * * *